US010940355B1

(12) United States Patent
Tang

(10) Patent No.: US 10,940,355 B1
(45) Date of Patent: Mar. 9, 2021

(54) EXERCISE RESISTANCE BAND WITH SILICONE MASSAGE DOTS

(71) Applicant: Yiwu Zhouyou Trade Co. Ltd., Zhejiang (CN)

(72) Inventor: Yinghong Tang, Zhoushan (CN)

(73) Assignee: Yiwu Zhouyou Trade Co. Ltd., Yiwu (CN)

( * ) Notice: Subject to any disclaimer, the term of this patent is extended or adjusted under 35 U.S.C. 154(b) by 0 days.

(21) Appl. No.: 16/908,605

(22) Filed: Jun. 22, 2020

Related U.S. Application Data

(63) Continuation of application No. 16/881,518, filed on May 22, 2020.

(30) Foreign Application Priority Data

Dec. 12, 2019 (CN) ..... 201922228131.6

(51) Int. Cl.
*A63B 21/055* (2006.01)
*A63B 21/00* (2006.01)

(52) U.S. Cl.
CPC ..... *A63B 21/0557* (2013.01); *A63B 21/0555* (2013.01); *A63B 21/4035* (2015.10); *A63B 2209/10* (2013.01); *A63B 2210/50* (2013.01); *A63B 2213/00* (2013.01)

(58) Field of Classification Search
CPC ..... A63B 21/02–0557; A63B 21/4009; A63B 2213/00; A61H 11/00–02; A61H 39/00; A61H 39/02–04; A61H 7/001–005; A61F 2/78–2002/807; A41F 1/00; A41D 20/00
See application file for complete search history.

(56) References Cited

U.S. PATENT DOCUMENTS

| | | | | |
|---|---|---|---|---|
| 4,944,289 | A * | 7/1990 | Matthews | A61H 7/001 128/97.1 |
| 5,945,060 | A | 8/1999 | Williams | |
| 6,969,362 | B2 * | 11/2005 | Wang | A61H 7/002 15/208 |
| 7,305,996 | B2 | 12/2007 | Kraft et al. | |
| 7,416,519 | B2 * | 8/2008 | Heck | A61H 11/02 482/121 |
| 9,656,115 | B2 * | 5/2017 | Young | A63B 21/068 |
| 2003/0093015 | A1 * | 5/2003 | Lo | A63B 21/0004 601/84 |
| 2007/0105696 | A1 | 5/2007 | Castel | |
| 2009/0162651 | A1 | 6/2009 | Rios et al. | |
| 2013/0045842 | A1 | 2/2013 | Wood | |

* cited by examiner

*Primary Examiner* — Jennifer Robertson
(74) *Attorney, Agent, or Firm* — Frank Gao, Esq.

(57) ABSTRACT

The invention relates to the technical field of exercise resistance bands, and particularly to an exercise resistance band with silicone massage dots, which enables massage at the time of fitness and is convenient to wear, and has the advantages of improving the storage effect and reducing the occupied area after storage. The exercise resistance band comprises an elastic hand, a hook-and-loop fastener and two elastic pull-up bands, wherein multiple sets of protruding silicone massage dots are adhered and fixed to an inner side of the elastic band, the hook-and-loop fastener comprises a hook and a loop, and the two elastic pull-up bands are respectively fixed on left and right sides of the elastic band.

5 Claims, 3 Drawing Sheets

EXERCISE RESISTANCE BAND WITH SILICONE MASSAGE DOTS

FIELD OF THE INVENTION

The invention relates to the technical field of exercise resistance bands, and particularly to an exercise resistance band with silicone massage dots.

BACKGROUND OF THE INVENTION

An exercise resistance band is an elastic band for fitness. During use, a person wears the band between thighs and then performs the pull-up action of the legs, thereby facilitating the fitness and shaping of the human legs and buttocks.

The existing exercise resistance band has a single function, and therefore cannot achieve the function of massage at the time of fitness, which is difficult to meet people's needs for the multi-functional use of the exercise resistance band. Moreover, in order to ensure the fitness effect, the stretching of the exercise resistance band will be done with greater effort so that a user will wear the band between thighs with greater effort, and the user also places the exercise resistance band randomly upon storage, resulting in a poor storage effect.

SUMMARY OF THE INVENTION

(I) Technical Problem to be Solved

In view of the disadvantages of the prior art, the invention provides an exercise resistance band with silicone massage dots, which enables massage at the time of fitness and is convenient to wear, and has the advantages of improving the storage effect and reducing the occupied area after storage.

(II) Technical Solution

To achieve the above object, the invention provides the following technical solution: an exercise resistance band with silicone massage dots comprises an elastic band, a hook-and-loop fastener and two elastic pull-up bands, wherein the elastic band is open at one end, the open end is connected by a suture, multiple sets of protruding silicone dots are adhered and fixed to an inner side of the elastic band, silicone massage dots in the each set of silicone dots are different in size, the silicone massage dots in the each set of silicone dots decrease sequentially in volume from the center to the outside, the hook-and-loop fastener comprises a hook and a loop, the hook and the loop are respectively fixed at an opening seam on a front side of the elastic band and a left half area on a rear side of the elastic band, and the two elastic pull-up bands are respectively fixed on left and right sides of the elastic band.

Preferably, the elastic band is an elastic band with latex threads inside.

Preferably, the hardness value of the silicone massage dots is between 15 and 20 HRC.

Preferably, the hook and the loop and the two elastic pull-up bands are sewn on the elastic band by the suture.

Preferably, inner side walls of the elastic pull-up bands contact an outer side wall of the elastic band.

(III) Advantageous Effects

Compared with the prior art; the invention provides an exercise resistance band with silicone massage dots, which has the following advantageous effects:

1. for the exercise resistance band with silicone massage dots, the multiple sets of silicone massage dots arranged on the inner side of the exercise resistance band can increase the friction and massage the parts in contact with the exercise resistance band while the legs are being pulled up; moreover, the open end of the exercise resistance band is sewn with the suture, so that the exercise resistance band can be customized and tailored in advance according to the perimeter of the legs of the human body; and the two open ends of the exercise resistance band are connected almost flush by the suture, so the exercise resistance band is worn without a feeling of protrusion and is more comfortable to use; and 2. for the exercise resistance band with silicone massage dots, the elastic pull-up bands fixed on both sides of the exercise resistance band are used as handles, a user holds the two elastic pull-up bands and pulls up the exercise resistance band to thighs and buttocks during fitness so as to facilitate wearing; moreover, the exercise resistance band is folded and then secured by the hook-and-loop fastener, thereby improving the storage effect and reducing the occupied area after storage.

Figure 1:
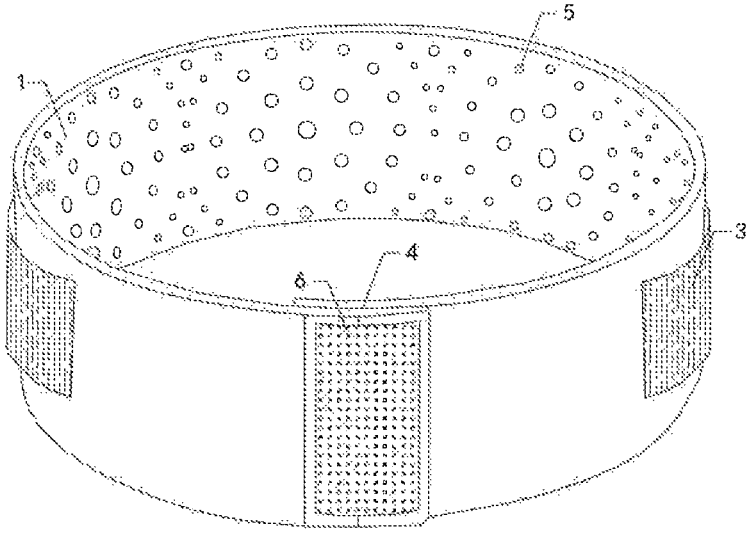
FIG. 1 is a perspective view of the invention.
Figure 2:
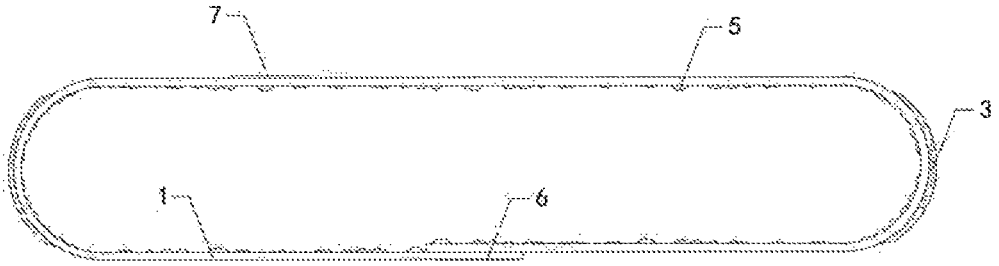
FIG. 2 is a top view of the invention.
Figure 3:
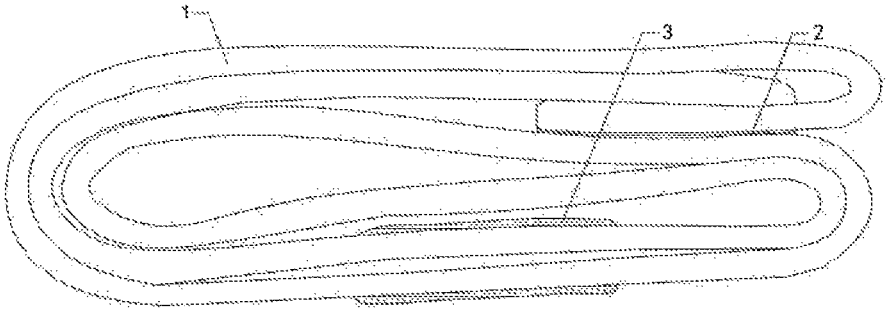
FIG. 3 is a front view of the invention after folding.
Figure 4:
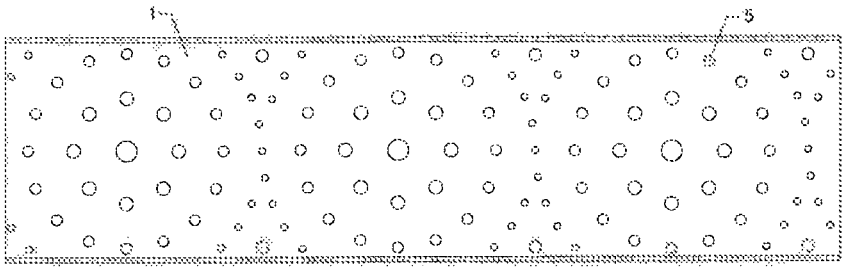
FIG. 4 is an internal schematic view of the invention.

In the Figures: 1. elastic band; 2. hook-and-loop fastener; 3. elastic pull-up band; 4. suture; 5. silicone massage dot; 6. hook; 7. loop.

DETAILED DESCRIPTION OF THE INVENTION

The technical solutions in the embodiments of the invention will be clearly and completely described below in conjunction with the drawings in the embodiments of the invention. It is apparent that the described embodiments are only part of rather than all of the embodiments in the invention. Based on the embodiments of the invention, all other embodiments obtained by the ordinary persons skilled in the art belong to the protection scope of the invention.

Those skilled in the art should understand that, in the disclosure of the invention, the directional or positional relationships indicated by the terms such as "longitudinal", "transverse", "upper", "lower", "front", "rear", "left", "right", "vertical", "horizontal", "top", "bottom" "inner" and "outer" are based on the directional or positional relationships shown in the drawings, which are merely for the convenience of describing the invention and for simplified description, and are not intended to indicate or imply that the devices or elements involved must have specific orientations and must be constructed and operated in specific orientations, and therefore the above terms cannot be construed as limiting the invention.

Referring to FIGS. 1. to 4, an exercise resistance band with silicone massage dots comprises an elastic band 1, a hook-and-loop fastener 2 and two elastic pull-up bands 3. The elastic band 1 is open at one end, and the open end is connected by a suture 4. The open end is sewn with the suture 4, so that the exercise resistance band can be customized and tailored in advance according to the perimeter of the legs of the human body. Moreover, the two open ends of the exercise resistance band are connected almost flush by the suture 4, so the exercise resistance band is worn without a feeling of protrusion and is more comfortable to use.

Multiple sets of protruding silicone dots are adhered and fixed to an inner side of the elastic band 1, silicone massage dots 5 in the each set of silicone dots are different in size, the silicone massage dots 5 in the each set of silicone dots decrease sequentially in volume from the center to the outside, and the multiple sets of silicone massage dots 5 can increase the friction and massage the parts in contact with the exercise resistance band while the legs are being pulled up. The hook-and-loop fastener 2 comprises a hook 6 and a loop 7, wherein the hook 6 and the loop 7 are respectively fixed at an opening seam on a front side of the elastic band 1 and a left half area on a rear side of the elastic band 1. The exercise resistance band is folded and then secured by the hook-and-loop fastener 2, which can improve the storage effect and reduce the occupied area after storage. The two elastic pull-up bands 3 are respectively fixed on left and right sides of the elastic band 1. During fitness, a user holds the two elastic pull-up bands 3 and pulls up the exercise resistance band to thighs and buttocks so as to facilitate wearing. The elastic band 1 is an elastic band with latex threads inside, the elastic band has low cost and good practicability, and the elastic band 1 is made softer by the characteristics of the latex threads. The hardness value of the silicone massage dots 5 is between 15 and 20 HRC to ensure the massage effect of the silicone massage dots 5. The hook 6 and the loop 7 and the two elastic pull-up bands 3 are sewn on the elastic band 1 by the suture 4. The suture 4 can ensure the effect of fixing the hook 6, the loop 7 and the elastic pull-up bands 3 to the elastic band 1. Inner side walls of the elastic pull-up bands 3 contact an outer side wall of the elastic band 1, and the closely arranged elastic pull-up bands 3 ensure their aesthetic appearance on the elastic band 1.

In summary, when the exercise resistance band with silicone massage dots is used, firstly, the elastic pull-up bands 3 fixed on both sides of the exercise resistance band are used as handles, a user holds the two elastic pull-up bands 3 respectively with both hands and puts the exercise resistance band on the outside of thighs and pulls up the exercise resistance band to the thighs and buttocks, and then the user squats to exercise; moreover, in the above process, the multiple sets of silicone massage dots 5 arranged on the inner side of the exercise resistance band can increase the friction and massage the parts in contact with the exercise resistance band while the legs are being pulled up; and, after use, the exercise resistance band can be removed and folded three times, and the hook 6 and the loop 7 on the exercise resistance band are adhered and fixed, thereby improving the storage effect and reducing the occupied area after storage. The open end of the exercise resistance band is sewn with the suture 4, so that the exercise resistance band can be customized and tailored in advance according to the perimeter of the legs of the human body. Moreover, the two open ends of the exercise resistance band are connected almost flush by the suture 4, so the exercise resistance band is worn without a feeling of protrusion and is more comfortable to use.

It can be understood that the term "a" should be construed as "at least one" or "one or more", i.e. the number of an element can be one in an embodiment while the number of the element can be more than one in other embodiments, so the term "a" cannot be construed as a limitation on the number.

The invention is not limited to the above most preferred embodiment, and various other forms of products can be obtained by any person under the inspiration of the invention. However, regardless of any change to its shape or structure, any technical solution which is the same as or similar to the present application shall fall into the protection scope of the invention.

I claim:

1. An exercise resistance band with silicone massage dots, comprising an elastic band, a hook-and-loop fastener and two elastic pull-up bands, the elastic band having first and second ends connected by a suture, multiple sets of protruding silicone dots being adhered and fixed to an inner side of the elastic band, silicone massage dots in the each set of silicone dots being different in size, the silicone massage dots in the each set of silicone dots decreasing sequentially in volume from a center of the set to an outside of the set, the hook-and-loop fastener comprising a hook portion and a loop portion, the hook portion and the loop portion being respectively fixed at the suture on a front side of the elastic band and a left half area on a rear side of the elastic band, and the two elastic pull-up bands being respectively fixed on left and right sides of the elastic band.

2. The exercise resistance band with silicone massage dots according to claim 1, wherein the elastic band is an elastic band with latex threads inside.

3. The exercise resistance band with silicone massage dots according to claim 1, wherein the hardness value of the silicone massage dots is between about 15 and about 20 Hardness Rockwell C (HRC).

4. The exercise resistance band with silicone massage dots according to claim 1, wherein the hook portion and the loop portion and the two elastic pull-up bands are sewn on the elastic band.

5. The exercise resistance band with silicone massage dots according to claim 1, wherein inner side walls of the elastic pull-up bands contact an outer side wall of the elastic band.

* * * * *